US007095977B2

(12) United States Patent
Nakamura

(10) Patent No.: US 7,095,977 B2
(45) Date of Patent: Aug. 22, 2006

(54) IMAGE FORMATION APPARATUS AND IMAGE FORMATION METHOD

(75) Inventor: Akihiro Nakamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 127 days.

(21) Appl. No.: 10/808,626

(22) Filed: Mar. 24, 2004

(65) Prior Publication Data

US 2004/0197109 A1 Oct. 7, 2004

(30) Foreign Application Priority Data

Apr. 1, 2003 (JP) ..... 2003-098085

(51) Int. Cl.
*G03G 15/00* (2006.01)

(52) U.S. Cl. ..... 399/396; 399/391; 399/393

(58) Field of Classification Search ..... 399/14, 399/18, 23, 391, 393, 396, 394
See application file for complete search history.

(56) References Cited

U.S. PATENT DOCUMENTS 5,966,555 A * 10/1999 Nakajima et al. ..... 399/18

6,463,240 B1 * 10/2002 Onuki et al. ..... 399/234

FOREIGN PATENT DOCUMENTS

JP 07-117872 A 5/1995
JP 2001005253 A * 1/2001

* cited by examiner

*Primary Examiner*—Ren Yan
(74) *Attorney, Agent, or Firm*—Canon U.S.A. Inc. IP Division

(57) ABSTRACT

An image formation apparatus comprises a transporting roller pair and resist roller pair for transporting sheets supplied from a sheet supplying device positioned relative to the image formation apparatus at a sheet supplying interval, and an image processing controller for receiving, from the sheet supplying device, information relating to the sheet supplying interval. In the event of the image formation apparatus transporting sheets supplied from the sheet supplying device, the transporting roller pair and resist roller pair transport the sheets at the sheet supplying interval, based on the information regarding the sheet supplying interval received by the image processing controller.

5 Claims, 6 Drawing Sheets

IMAGE FORMATION APPARATUS AND IMAGE FORMATION METHOD

BACKGROUND OF THE INVENTION

1. Field of the Invention

The present invention relates to an image formation apparatus and an image formation method.

2. Description of the Related Art

Generally, with image formation apparatuses which form images on recording sheets such as paper or the like, various detachable optional sheet supplying devices are detachably mounted to the image formation apparatus for supplying sheets to the image formation apparatus. Each of the various optional sheet supplying devices for specific image formation apparatuses may differ in the transportation speed at which the sheets are transported to the image formation apparatus, and the distance from the position where the sheets are loaded to the position where the sheets are received by the image formation apparatus, so in such cases the time from the image formation apparatus transmitting a command to the optional sheet supplying device to the effect that a sheet should be fed out and supplied to the image formation apparatus to the sheet reaching the position where the sheets are received by the image formation apparatus differs from case to case.

Accordingly, an arrangement has been employed wherein, in order to perform image formation corresponding to various types of optional sheet supplying devices with different time required for the sheets to reach the position of the image formation apparatus for receiving the sheets, the time required is stored in the optional sheet supplying device beforehand, and the image formation apparatus performs image formation actions corresponding to that optional sheet supplying device by making reference to this time required (e.g., Japanese Patent Laid-Open No. 7-117872).

However, with image formation actions using the conventional method, jamming detection and the like can be suitably performed corresponding to the mounting position of the optional sheet supplying device as to the image formation apparatus, but there are also some problems which the above-described required time alone cannot solve.

For example, the following problems may occur with electrophotography image formation apparatuses using the intermediate transfer method. Note that intermediate transfer is a method wherein multiple color toner images, each of a different color, are subjected to primary transfer from photosensitive drums onto an intermediate transfer belt where they are overlaid, and then the toner image made up of multiple colors is transferred all at once by secondary transfer onto a sheet which has been transported separately.

With electrophotographic image formation apparatuses using intermediate transfer, the amount of time from starting primary transfer, i.e., the time of the first color toner image being transferred onto the intermediate transfer belt, to starting secondary transfer of the image formed by the multiple color toner images which have been overlaid (hereafter referred to as "image formation time"), may be longer than the time necessary for the sheet to be picked up and transported to the secondary transfer portions (hereafter referred to as "sheet transport time"), depending on the optional sheet supplying device.

In such cases, a sheet upon which an image of a page is to be transferred is picked up from the optional sheet supplying device following starting the image formation of that page at the image formation apparatus, so at the point that there are no more sheets loaded on the optional sheet supplying device, image formation for the next page has already started, meaning that a toner image with no sheet to be transferred onto is formed on the intermediate transfer belt, necessitating cleaning processing and the like as well as adversely affecting the longevity of the photosensitive drum.

In order to solve such problems, it is desirable to have a configuration wherein the sheet supplying interval at which the optional sheet supplying device feeds sheets can be optionally switched over according to various conditions such as the number of remaining sheets, and wherein the image formation apparatus performs actions corresponding to the sheet supplying interval of the sheets being supplied from the optional sheet supplying device detachably mounted to the image formation apparatus.

SUMMARY OF THE INVENTION

The present invention has been made in light of the above-described problems, and accordingly, the present invention is directed to an image formation system incorporating an image formation apparatus including a sheet transporter transporting sheets at sheet supplying intervals based on information relating to the sheet supplying interval received from a sheet supplying device detachably mounted and positioned relative to the image formation apparatus feeding sheets to the image formation apparatus.

In one aspect, the image formation apparatus comprises: a sheet transporting unit transporting sheets fed from the sheet supplying device detachably mounted to the image formation apparatus, the sheets being fed at the predetermined sheet feeding interval; an image formation unit forming an image on sheets transported by the sheet transporting unit; and a receiving unit for receiving information relating to the sheet feeding interval from the sheet supplying device; wherein the sheet transporting unit, responsive to the information on the sheet feeding interval, transports the sheets supplied at the sheet feeding interval.

Further aspects, features and advantages of the present invention will become apparent from the following description of the preferred embodiments with reference to the attached drawings.

DESCRIPTION OF THE PREFERRED EMBODIMENTS

Embodiments of the present invention will now be described with reference to the drawings.

FIRST EMBODIMENT

Figure 1:
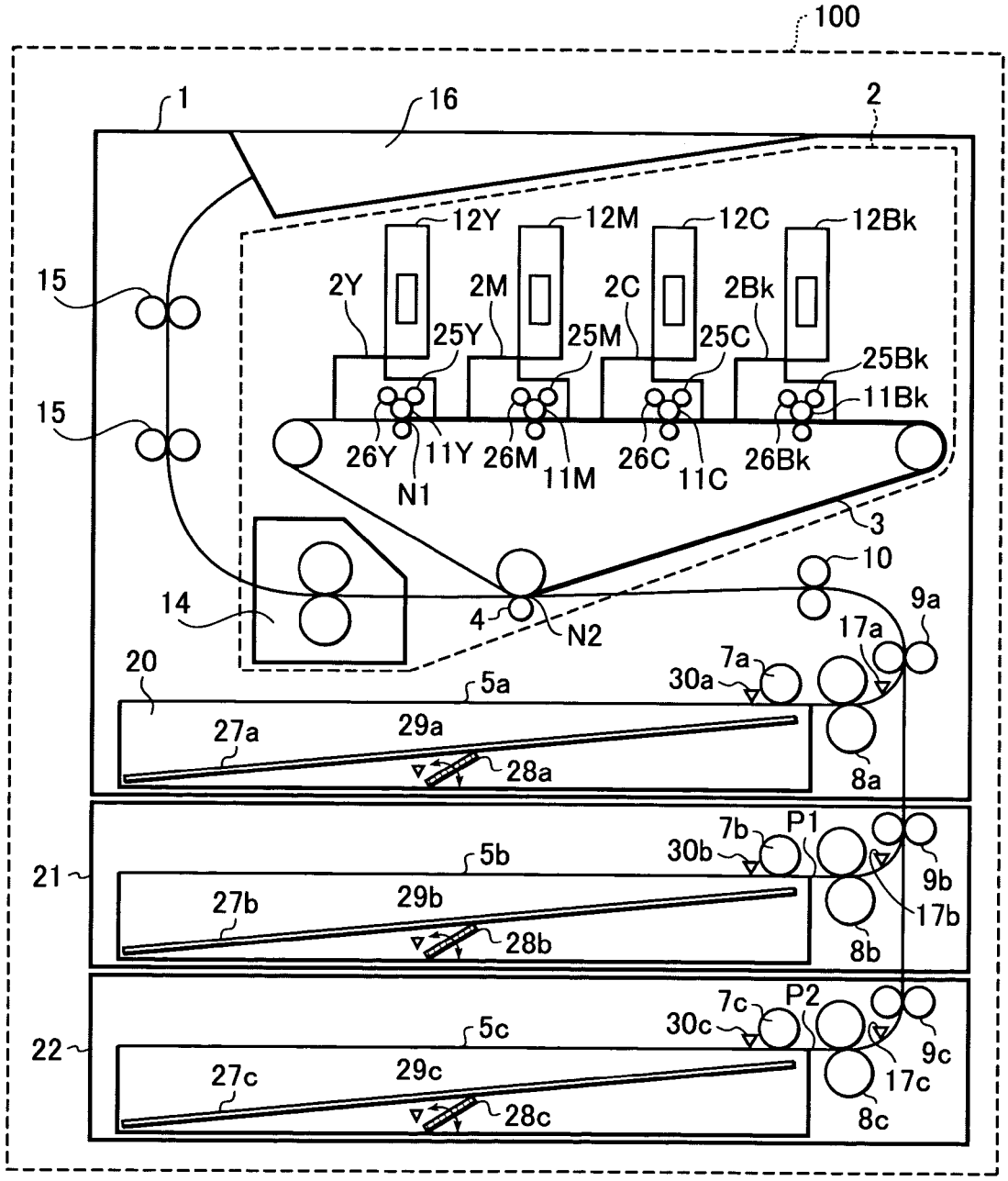
FIG. 1 is a cross-sectional diagram illustrating the overall configuration of an image formation system including a full-color image formation apparatus using intermediate transfer, and an optional sheet supplying device detachably mounted to the image formation apparatus.

First, a first embodiment of the present invention will be described. FIG. 1 is a cross-sectional diagram illustrating an overall configuration of an image formation system 100 in accordance with one embodiment of the present invention. The system 100 includes a full-color image formation apparatus using intermediate transfer and a sheet supplying device. In FIG. 1, reference numeral 1 denotes the image formation apparatus, with optional sheet supplying devices 21 and 22 detachably mounted thereto.

Reference numeral 2 denotes an image formation block of the image formation apparatus 1, indicated by dotted lines in FIG. 1. This image formation block 2 includes: image formation units 2Y, 2M, 2C, and 2Bk for forming toner images on respective photosensitive drums 11Y, 11M, 11C, and 11Bk, which are image carrying members; an intermediate transfer belt 3 for receiving the toner images carried by the image formation units 2Y, 2M, 2C, and 2Bk in a primary image transfer; a secondary transfer roller 4 for performing secondary image transfer of the toner images, overlaid on the intermediate transfer belt 3 in the primary image transfer, onto a sheet S (not shown) at a secondary transfer position N2; and a fixing unit 14 for performing thermal fixing while pressing the toner image transferred onto the sheet S at the secondary transfer position N2.

As stated above, the image formation units 2Y, 2M, 2C, and 2Bk have the respective photosensitive drums 11Y, 11M, 11C, and 11Bk. The photosensitive drums 11Y, 1M, 11C and 11Bk have respective charging units 25Y, 25M, 25C, and 25Bk, for charging the respective photosensitive drums, and respective laser scanning units 12Y, 12M, 12C, and 12Bk for irradiating the surfaces of the photosensitive drums 11Y, 11M, 11C, and 11Bk with laser beams corresponding to image signals, so as to form electrostatic latent images thereon. Further provided are developing units 26Y, 26M, 26C, and 26Bk for developing, with toner, the electrostatic latent images formed on the respective photosensitive drums 11Y, 11M, 11C, and 11Bk.

Having described the configuration thus far, the image formation units, photosensitive drums, laser scanning units, charging units, and developing units each are of the same configuration for each color, and accordingly will be referred to simply as image formation unit 2, photosensitive drum 11, laser scanning unit 12, charging unit 25, and developing unit 26, unless differentiation of color is pertinent to the description.

Also, the image formation apparatus 1 has a discharge roller pair 15 for externally discharging the sheet S subsequent to the fixing unit 14 fixing toner on the sheet S, and a discharge tray 16 where the sheets S discharged by the discharge roller pair 15 are stacked.

The system 100 includes one or more sheet supplying devices for feeding sheets to the image formation block 2. The sheet supplying devices can be integral with the image formation apparatus 1, such as a sheet supplying device 20. The sheet supplying devices can also be detachably mounted to the apparatus 1, such as optional sheet supplying devices 21 and 22. The optional sheet supplying device 21 can be detachably mounted to the image formation apparatus 1, housing and feeding sheets S to the image formation apparatus 1. The optional sheet supplying device 22 can have the same configuration as the optional sheet supplying device 21 and can be sequentially connected to the optional sheet supplying device 21 as shown in FIG. 1.

The sheet supplying device 20 includes: a sheet loading unit 5*a* for loading the sheets S; a lifter plate 27*a* provided within the sheet loading unit 5*a* for loading the sheets S; a lifter 28*a* capable of turning in the direction indicated by the arrow in FIG. 1 in order to lift the lifter plate 27*a*; a remaining sheet detecting sensor 29*a* for detecting the remaining number of sheets loaded on the sheet loading unit 5*a* by detecting the turning position of the lifter 28*a*; and a sheet presence detection sensor 30*a* for detecting the surface of the topmost sheet S loaded on the lifter plate 27*a*.

It will be understood by viewing FIG. 1 that the sheet loading unit 5*a* of the sheet supplying device 20 and the sheet loading units 5*b* and 5*c* of the optional sheet supplying devices 21 and 22, and the components peripheral thereto, each have configurations which are generally the same, and comprise equivalent or identical components which are denoted by the same reference numerals, except that those of the sheet supplying device 20 are followed by "a", those of the optional sheet supplying device 21 by "b", and those of the optional sheet supplying device 22 by "c". In the following description, these components will be collectively denoted by their reference numerals except in cases wherein it is necessary to distinguish between the devices to which the components belong.

The sheet supplying devices further include pick-up rollers 7 for supplying sheets S; retarding roller pairs 8 for separating the sheets S supplied from the pick-up rollers 7 into individual sheets so that multiple sheets S are not transported at the same time; transporting roller pairs 9 for further transporting the sheets S; and sheet supplying cassette transporting detection sensors 17 disposed between the retarding roller pairs 8 and the transporting roller pairs 9. The apparatus 1 further includes resist roller pairs 10 for facilitating transporting the sheets S, transported by the transporting roller pairs 9, to the image formation block 2.

Next, the control configuration of the full-color image formation apparatus 1 using intermediate transfer according to the first embodiment will be described with reference to FIG. 2. The sheet supplying devices 20, 21 and 22 include sheet supplying device control units 210, 211 and 212. The image formation apparatus 1 includes an image processing controller 201, having a host computer 200, capable of communicating with the sheet supplying device control units 211 and 212. The image processing controller further includes an image formation controller 202. The image processing controller 201 receives image information and print commands from the host computer 200, analyzes the received image information and converts this information into bitmap data, and transmits video signals including print reservation commands, print start commands, and the bitmap data, corresponding to each of the sheets S onto which the image information is to be printed, to a CPU 203 of the image formation controller 202. Also, the image processing controller 201 transmits action information regarding the sheets S onto which the image information is to be printed, to the optional sheet supplying device control unit 211 and optional sheet supplying device control unit 212, based on the commands from the host computer 200. The optional sheet supplying device control units 211 and 212 control motor devices (not shown) such as stepping motors and the like of the sheet supplying rollers 7, retarding roller pairs 8, transporting roller pairs 9, and so forth, for driving the respective components, based on action information received from the image processing controller 201.

The image formation controller 202 has the CPU 203 for receiving information such as video signals and the like from the image processing controller 201, and various components controlled by the CPU 203. These components include: a sheet transportation control unit 204 for controlling the rollers of the image formation apparatus 1 for transporting the sheets S; a charging control unit 205 for controlling the voltage applied to the charging rollers 25 in order to charge the photosensitive drums 11 to a predetermined potential; a laser scanning control unit 206 for controlling the laser scanning for exposing the surface of the photosensitive drums 11 based on video signals which the CPU 203 has received from the image processing controller 201; a developing control unit 207 for controlling developing units 26 so as to develop the electrostatic latent images formed on the surface of the photosensitive drums 11; a transfer control unit 208 for controlling transfer voltage to be applied to the transfer roller 4 so that the toner image formed on the intermediate transfer belt 3 is transferred onto the sheets S; a fixing control unit 209 for controlling turning on of electric power to a heater or heaters which at least one of the rotating rollers making up the fixing unit 14 has, so as to fix the toner image which has been transferred onto the sheet S by secondary image transfer; and a sheet supplying device control unit 210 for controlling the motors and the like of the sheet supplying device 20, which drive the sheet supplying rollers 7 and the like, such that the sheets S are fed to the image formation block 2.

Now, the optional sheet supplying device control unit 211 can be configured to optionally set an interval (time interval) for supplying the sheets S. The reason that the optional sheet supplying device control unit 211 optionally sets the interval between sheets S is as follows.

In the intermediate transfer image formation apparatus 1 shown in FIG. 1, the time from starting image formation to transferring the toner image onto the sheet S (an image formation time) is substantially proportional to the distance from the primary transfer nip portion N1 (where the photosensitive drum 11Y of the image formation unit 2Y for yellow (Y), which is situated farthest upstream in the rotational direction of the intermediate transfer belt 3, and the intermediate transfer belt 3 come into contact) to the secondary nip portion N2 (where the intermediate transfer belt 3 and the secondary transfer roller 4 come into contact) (this distance is indicated by a heavy solid line in FIG. 1). On the other hand, transporting a sheet S from the optional sheet supplying device 21 in order to transfer a toner image onto the sheet S requires a sheet transporting time substantially proportional to the distance from point P1 in FIG. 1 to the secondary transfer nip portion N2. Now, let us assume that the rotational speed of the intermediate transfer belt 3 within the image formation apparatus 1, and the transporting speed at which the optional sheet supplying device 21 and the image formation apparatus 1 transport the sheet S, is the same speed.

In this case, the distance on the intermediate transfer belt 3 from N1 to N2 in FIG. 1 is longer than the distance on the transportation path from P1 to N2, so transportation of the sheet S onto which the toner image formed by the image formation operations is to be transferred, is started subsequent to start of the image formation operations at the image formation block 2. Note that this configuration is employed in order to increase the number of pages upon which images can be formed per unit time, by reducing the image formation intervals.

Figure 3:
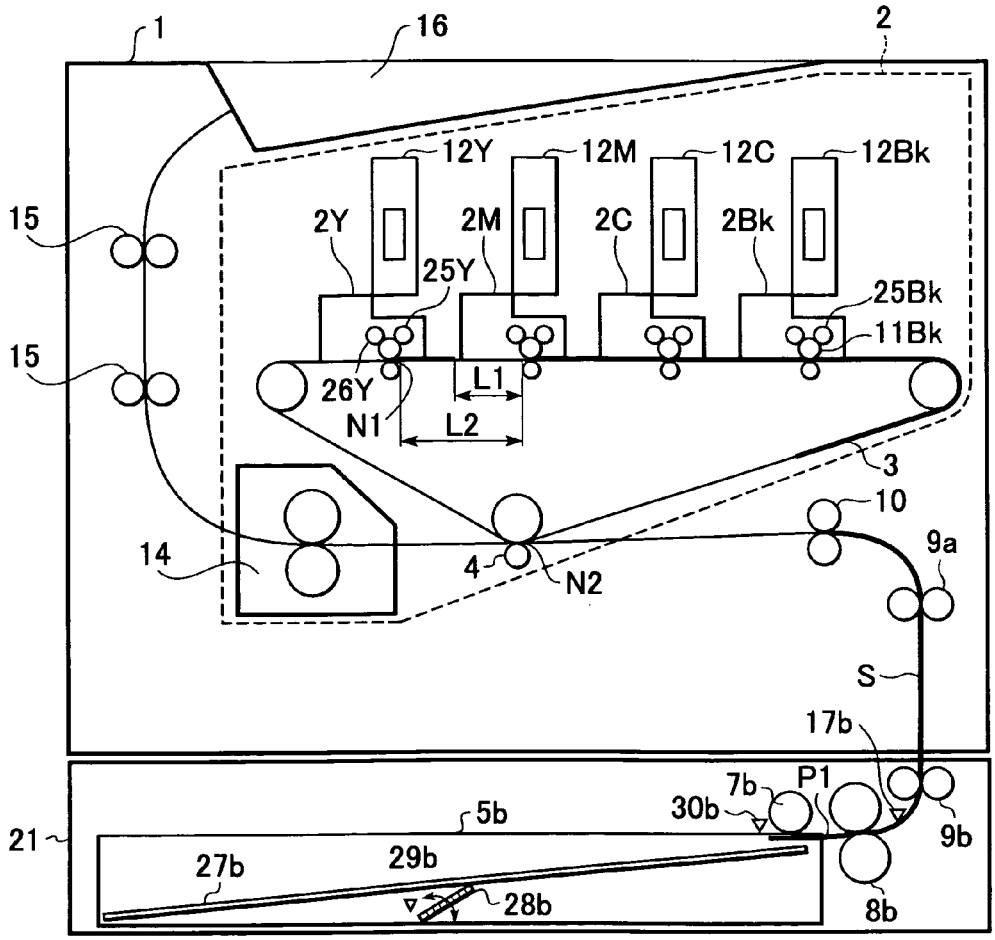
FIG. 3 is a diagram illustrating the state of operation at the point that the last sheet has been supplied from a sheet loading unit.

Accordingly, in the event that there are no more sheets remaining loaded on the optional sheet supplying device 21 partway through consecutively forming images on multiple pages, image formation of the next page has already begun at the point that detection is made that there are no more sheets left. Specifically, as shown in FIG. 3, detection of the last sheet S supplied from the sheet loading unit 5*b*, whether or not the sheet S is actually the last sheet and that no more sheets S can be supplied therefrom, is detected when the trailing edge of the sheet S passes over the sheet presence detection sensor 30*b*. In the event that the image formation interval between the multiple pages is L1 (as shown in FIG. 3), this means that primary image transfer onto the intermediate transfer belt 3 of the toner image for the sheet following the last sheet S has already started. This necessitates cleaning processing and the like of the toner image formed upon the intermediate transfer belt 3, as well as adversely affecting the longevity of the photosensitive drum.

Accordingly, in the event that a remaining sheet detecting sensor 29*b* detects that there is only a predetermined or small number of sheets remain (e.g., 5% or less of the maximum load) in the optional sheet supplying device 21, extending the image formation interval onto the intermediate transfer belt 3 and the supplying interval of sheets S is effective. Specifically, as shown in FIG. 3, making the image formation interval to be longer than L2 enables image formation of a page following the last sheet S to be stopped at the point that detection is made that there are no sheets S following the last sheet S having been supplied from the sheet loading unit 5*a*.

As described above, in order to enable image formation operations which are suitable according to the remaining number of sheets S loaded on the optional sheet supplying device 21, the optional sheet supplying device control unit 211 of the optional sheet supplying device 21 transmits, to the image formation controller 201 of the image formation apparatus 1, information indicating the sheet supplying interval L1, which is a first sheet supplying interval, in the event that the remaining number of sheets S detected by the remaining sheet detecting sensor 29*b* exceeds the predetermined number of remaining sheets (e.g., 5% of the maximum load), and transmits information indicating a second sheet supplying interval L3 (which is greater than L2) in the event that the remaining number of sheets S is equal to or less than the predetermined number of remaining sheets (e.g., 5% or less of the maximum load). The image processing controller 201 transmits the received sheet supplying interval to the CPU 203 of the image formation controller 202 so as to be reflected in the sheet transporting intervals under sheet transporting control by the sheet transporting control unit 204.

The above has been a description regarding the configuration for transmitting information relating to the sheet supplying interval of the sheets S from the optional sheet supplying device control unit 211 of the optional sheet supplying device 21 to the image processing controller 201 of the image formation apparatus 1. It should be noted that the optional sheet supplying device 22 also has the same configuration as the optional sheet supplying device 21, and that the distance on the intermediate transfer belt 3 from N1 to N2 is longer than the distance on the transporting path from P2 to N2. Note that the optional sheet supplying device 22 operates in substantially the same manner as the optional sheet supplying device 21.

Figure 4:
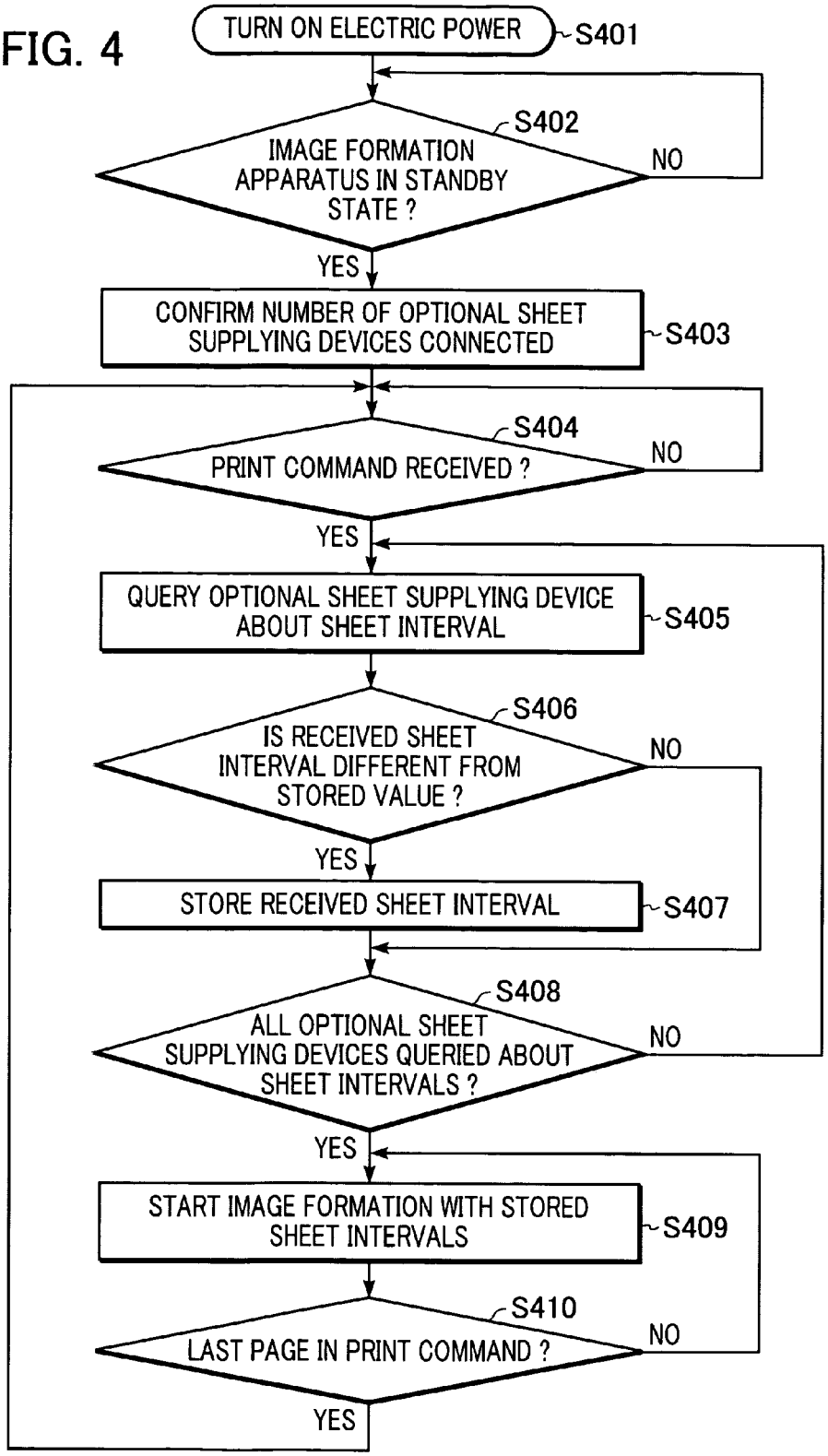
FIG. 4 is a flowchart illustrating the operations of the full-color image formation apparatus using intermediate transfer.

Next, the operations of the full-color image formation apparatus using the intermediate transfer method according to the first embodiment will be described with reference to the flowchart shown in FIG. 4.

In step S401, the operations of the image formation apparatus 1 are started by the electric power source being turned on. Specifically, as initialization actions of the image formation apparatus 1 for reaching a standby state wherein image formation can be made, the charging control unit 205 controls the charging voltages to be applied to the charging rollers 25, so as to charge the photosensitive drums 11 to a predetermined potential. Also, at the time of initialization, the photosensitive drums 11, intermediate transfer belt 3, secondary roller 4, and so forth, are rotationally driven by a driving motor (not shown) under control of the sheet transportation control unit 204.

In step S402, determination is made whether or not the image formation apparatus 1 has made transition to a standby state wherein image formation can be made, and in the event that this is determined to be so (YES in step S402), the flow proceeds to step S403.

Figure 2:
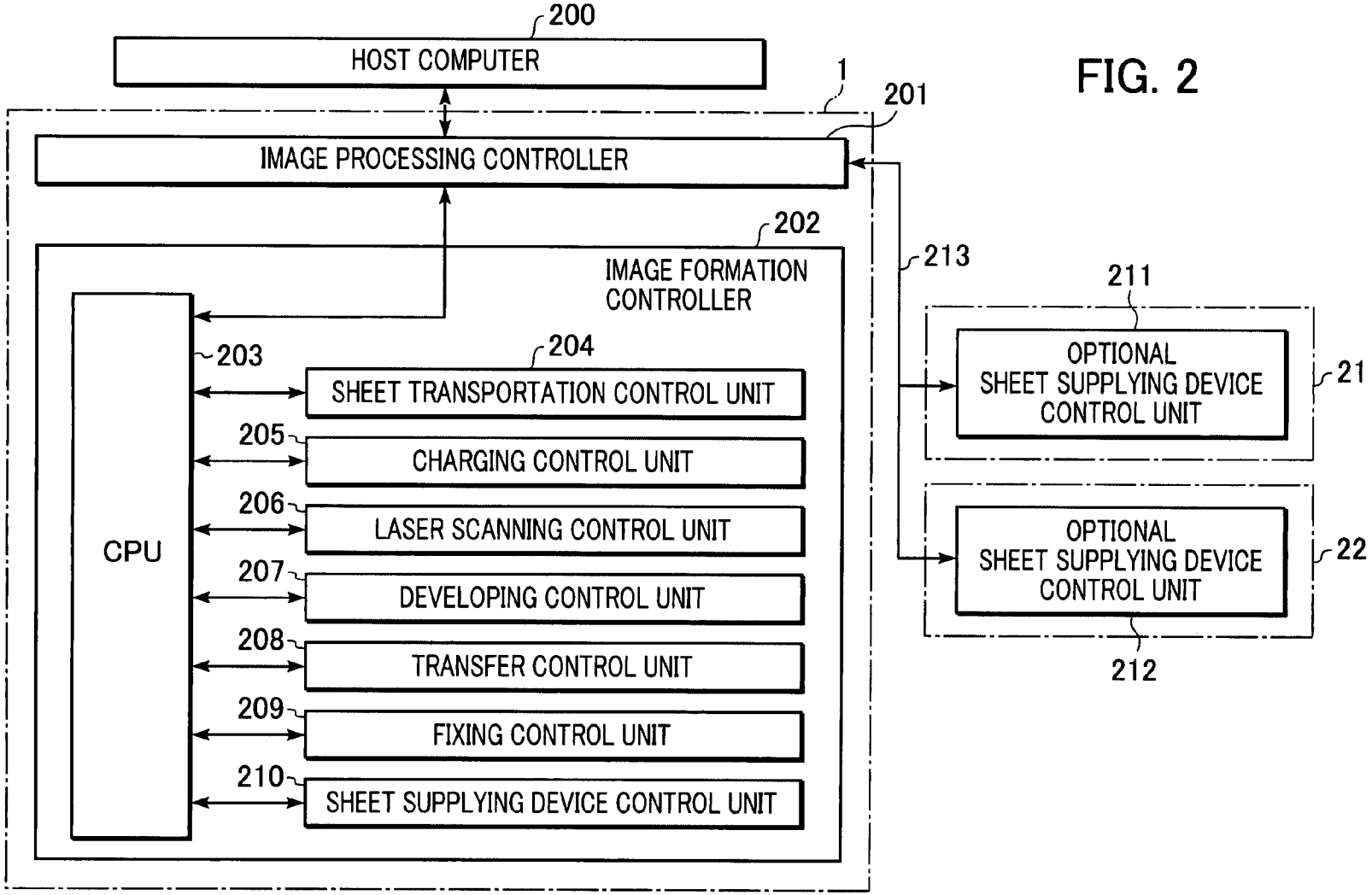
FIG. 2 is a block diagram illustrating the control configuration of the full-color image formation apparatus using intermediate transfer.

In step S403, the image processing controller 201 confirms or determines the number of optional sheet supplying devices connected to the image formation apparatus 1 by communication via an interface 213 (shown in FIG. 2).

In step S404, the image processing controller 201 determines whether or not a print command has been received from the host computer 200, and in the event that a print command has been received, proceeds to step S405. Note that a print command includes information such as the sheet supply portion for sheets S upon which the pages of the print command are to be printed (in FIG. 1, one of the sheet loading units 5*a*, 5*b*, and 5*c*), the number of pages to be printed with regard to the print command, and so forth.

In step S405, the image processing controller 201 makes a query to an optional sheet supplying device detachable mounted to the image formation apparatus 1 regarding the sheet supplying interval. In the case of the configuration shown in FIG. 1, two optional sheet supplying devices are mounted to the image formation apparatus 1, i.e., the optional sheet supplying device 21 and the optional sheet supplying device 22. For example, the controller 201 can query the optional sheet supplying device control unit 211 of the optional sheet supplying device 21.

In step S406, the image processing controller 201 receives the information indicating the sheet supplying interval transmitted from the optional sheet supplying device control unit 211 in response to the query in step S405, and determines whether or not the received information indicating the sheet supplying interval differs from the information stored in a storage unit (not shown), such as memory or the like, of the image formation controller 202 indicating the sheet supplying interval of the optional sheet supplying device 21. In the event that the stored information indicating the sheet supplying interval of the optional sheet supplying device 21 is different, the optional sheet supplying device 21 is determined to have switched the sheet supplying interval of the sheets S (YES in step S406), and the information indicating the new sheet supplying interval received from the optional sheet supplying device control unit 211 is stored in the memory of the image formation controller 202 (step S407). Note that the optional sheet supplying device 21 switches the sheet supplying interval of the sheets S in the event that the remaining number of the sheets S is small (e.g., 5% or less of the maximum load).

In step S406, in the event that the information regarding the sheet supplying interval received from the optional sheet supplying device control unit 211 is the same as the stored information, the optional sheet supplying device 21 is determined not to have switched the sheet supplying interval of the sheets S (NO in step S406), and the flow proceeds to step S408.

In step S408, determination is made regarding whether or not all optional sheet supplying devices detachably connected to the image formation apparatus 1 have been queried regarding the sheet supplying intervals. In the configuration shown in FIG. 1, following querying the optional sheet supplying device 21 regarding the sheet supplying interval, a judgment of NO is made and the flow proceeds to step S405 in order to query the optional sheet supplying device 22 in the same way. Following querying both optional sheet supplying devices 21 and 22, a judgment of YES is made and the flow proceeds to step S409.

In step S409, the image formation controller 202 starts image formation operations such as transporting the sheets S to the image formation block 2 at the sheet supplying intervals of each of the sheet supplying portions stored in the memory of the image formation controller 202. That is to say, in the event that the image formation controller 202 receives information indicating a new sheet supplying interval from the optional sheet supplying device 21 as a result of the query made to the optional sheet supplying device 21 by the image processing controller, determination is made that the information indicating the sheet supplying interval has been switched since the image formation operations relating to the previous printing command. The image formation controller 202 switches the sheet supplying interval from the sheet supplying interval (time interval) for transporting sheets S supplied from the optional sheet supplying device 21 for the previous printing command to a sheet supplying interval for the new printing command, and accordingly transports sheets S.

The following operations are carried out before and after image formation is started in step S409. First, in a case wherein the host computer 200 has specified that sheets should be supplied from the optional sheet supplying device 21, and wherein the sheet supplying interval which the image processing controller 201 has received from the optional sheet supplying device control unit 211 prior to starting image formation is L3, which is the second sheet supplying interval, the image processing controller 201 receives the detection results of the sheet presence detection sensor 30*b* received from the optional sheet supplying device control unit 211. In the event that the detection results provide information indicating that there are no more sheets S remaining in the optional sheet supplying device 21, the flow does not go to the processing for starting image formation, but rather makes a display on an operation panel or the like (not shown) on the image formation apparatus 1 to show that sheets S should be supplied to the optional sheet supplying device 21.

On the other hand, in the event that the detection results provide information indicating that there are sheets S remaining in the optional sheet supplying device 21, the flow goes to the processing for starting image formation.

In the event that the sheet supplying interval which the image processing controller 201 has received from the optional sheet supplying device control unit 211 is L1, which is the first sheet supplying interval, judgment is made that there are sufficient sheets S in the optional sheet supplying device 21, so the flow goes to the processing for starting image formation.

In order to start image formation of an n'th page of a printing command, the image processing controller 201 sends to the image formation controller 202 an image formation command for the n'th page. Upon receiving the image formation command for the n'th page, the image formation controller 202 forms the image for the n'th page by charging the photosensitive drum 11Y, exposes the photosensitive drum 11Y with the laser scanning unit 12Y, and develops the electrostatic latent image on the photosensitive drum 11Y with the developing unit 26Y, and then performs primary transfer of the toner image on the photosensitive drum 11Y onto the intermediate transfer belt 3. Charging, exposure, and developing steps performed for the photosensitive drum 11Y are also performed for each of the photosensitive drums 11M, 11C, and 11Bk, and the toner images of each color are sequentially layered onto the yellow toner image on the intermediate transfer belt 3, thereby forming a color toner image.

In addition, in order to start image formation for the n'th page, a sheet supply command is sent from the image processing controller 201 to the optional sheet supplying device control unit 211 to the effect that a sheet S should be supplied. Upon receiving the sheet supplying command, the optional sheet supplying device control unit 211 starts supplying the sheet S by driving the pick-up roller 7*b*. A sheet S supplied by the pick-up roller 7*b* is separated from the other sheets by a retarding roller 8*b* so as to prevent multiple sheets from being transported at once, and the sheet S is supplied to the image formation apparatus 1 by the transporting roller 9*b*. The image formation controller 202 transports the sheet S from the optional sheet supplying device 21 with the transporting roller 9*a* as far as the resist roller pair 10. A resist sensor (not shown) is disposed upstream in the transportation direction from the resist roller pair 10, and control is effected by the image formation controller 202 so that the leading edge of the sheet S stops at the resist roller pair 10.

The image formation controller 202 starts transferring the color toner image on the intermediate transfer belt 3 onto the sheet S at the secondary transfer nip portion N2.

Subsequently, the image formation controller 202 causes the sheet S to pass through the fixing unit 14 where the color toner image is fixed thereupon the sheet. Then, the sheet S upon which the color toner image has been fixed is transported by the discharge roller 15 and is discharged to the discharge tray 16.

In step S410, whether or not the image processing controller 201 has given an image formation command to the image formation controller 202 regarding the final page of the print command, and in the event that an image information command regarding the final page has not been made (NO in step S410), the flow returns to step S409 and an image formation command is given regarding the subsequent page. The image formation controller 202 which has received an image formation command from the image processing controller 201 transports a sheet S at the sheet supplying interval stored in the memory of the image formation controller 202, and transport of the sheet S is started such that the sheet supplying interval is the same as with the previous page. In the event that an image formation command regarding the final page has been made (YES in step S410), the flow returns to step S404 and awaits reception of a new printing command from the host computer 200.

As described above, in the event that the sheet supplying interval of sheets S supplied from the optional sheet supplying device 21 or optional sheet supplying device 22 detachably connected to the image formation apparatus 1 is switched, the image formation apparatus 1 switches the sheet feeding interval of the sheets S being transported to the image formation block 2 as appropriate, so the image formation interval at the image formation block 2 can be expanded in the event that the number of sheets loaded in the optional sheet supplying device 21 or the optional sheet supplying device 22 is small (e.g., 5% or less of a full load). In the event that there are no more sheets in the optional sheet supplying device 21 or the optional sheet supplying device 22, image formation of the subsequent page is not started, so there is no formation of a toner image which cannot be transferred on the intermediate transfer belt 3.

SECOND EMBODIMENT

Figure 5:
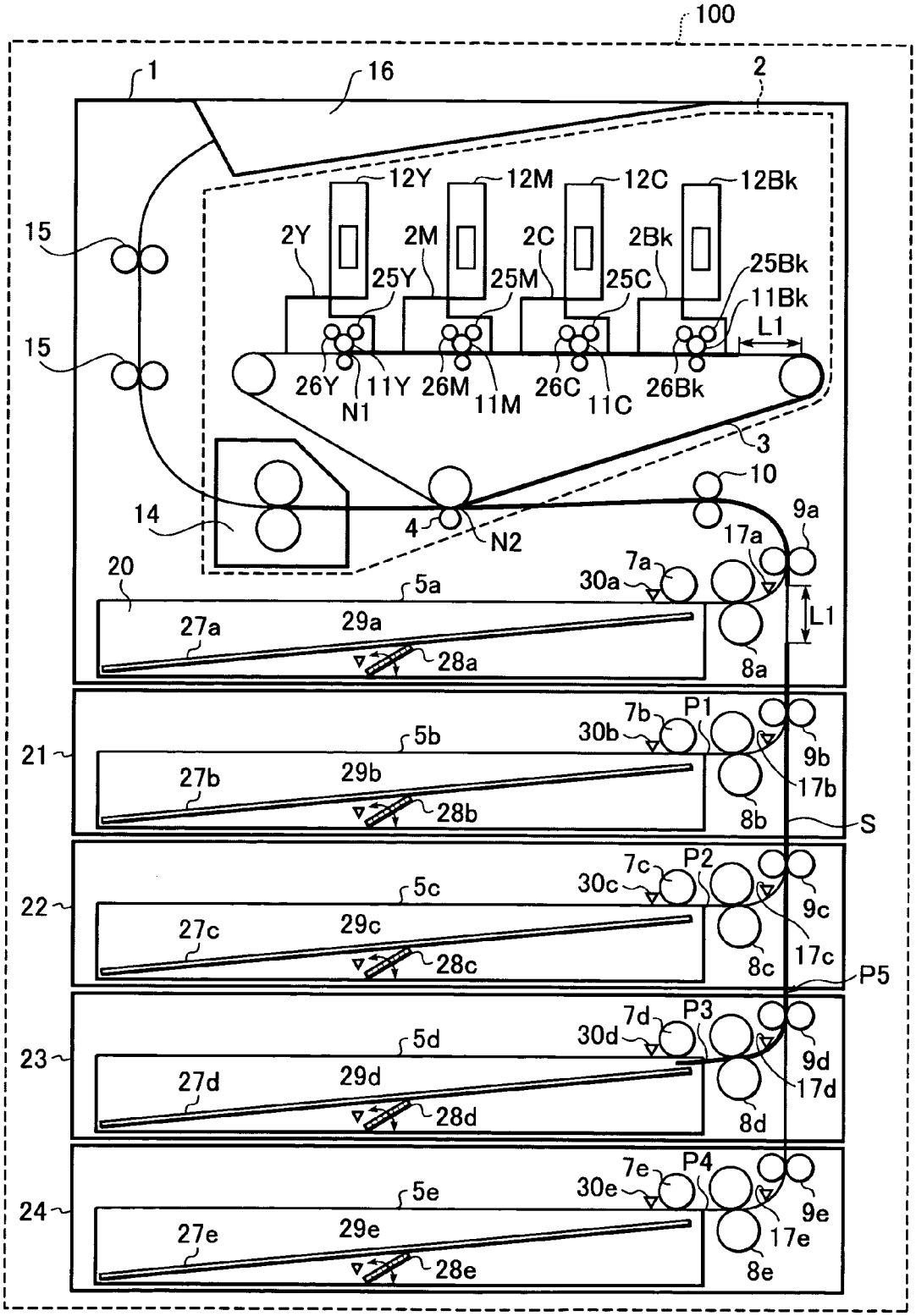
FIG. 5 is a cross-sectional diagram illustrating the overall configuration of a full-color image formation apparatus using intermediate transfer, and an optional sheet supplying device detachably mounted to the image formation apparatus.

Next, a second embodiment of the present invention will be described. FIG. 5 is a cross-sectional diagram illustrating the overall configuration of a full-color image formation apparatus using intermediate transfer, and optional sheet supplying devices detachably mounted to the image formation apparatus. FIG. 5 incorporates the components of the image formation apparatus and the optional sheet supplying devices detachably mounted to the image formation apparatus shown in FIG. 1, and further comprises optional sheet supplying devices 23 and 24 detachably mounted to the image formation apparatus 1, which are not included in the arrangement shown in FIG. 1.

As described above with the first embodiment, the distance from the first transfer nip portion N1 to the secondary transfer nip portion N2 is longer than both the transporting distance for the sheets S from the sheet supplying position P1 where sheets are supplied from the optional sheet supplying device 21 to the secondary transfer nip portion N2, and the transporting distance for the sheets S from the sheet supplying position P2 where sheets are supplied from the optional sheet supplying device 21 to the secondary transfer nip portion N2.

On the other hand, with the second embodiment, the distance from the first transfer nip portion N1 to the secondary transfer nip portion N2, and the distance from P5 in FIG. 5 to the secondary transfer nip portion N2, are equal. Accordingly, the distance from the first transfer nip portion N1 to the secondary transfer nip portion N2 is shorter than either of the transporting distance for the sheets S from the sheet supplying position P3 where sheets are supplied from the optional sheet supplying device 23 to the secondary transfer nip portion N2, and the transporting distance for the sheets S from the sheet supplying position P4 where sheets are supplied from the optional sheet supplying device 24 to the secondary transfer nip portion N2.

While the control configuration of the intermediate transfer type full-color image formation apparatus according to the second embodiment is not shown in the drawings, the optional sheet supplying devices 23 and 24 include optional sheet supplying device control units.

With the first embodiment, in the event that the image formation interval for multiple pages are set at L1 for both the optional sheet supplying devices 21 and 22 detachably mounted to the image formation apparatus 1, at the point that detection is made that there are no more sheets S loaded on the sheet loading unit 5*b* or 5*c*, image formation has already been started at the intermediate transfer belt 3 for the following page.

On the other hand, with the second embodiment, with regard to the optional sheet supplying devices 23 and 24 disposed below the optional sheet supplying devices 21 and 22, even in the event that the image formation interval for multiple pages are set at L1, image formation is not started at the intermediate transfer belt 3 for the following page at the point that detection is made that there are no more sheets S loaded on the sheet loading unit 5*d* or 5*e*.

FIG. 5 illustrates the image formation state of the image formation apparatus 1 and the transportation state of the sheet S in a state wherein the sheet presence detection sensor 30*d* detects the trailing edge of the last sheet S leaving the optional sheet supplying device 23, and unlike the case shown in FIG. 3 (for supplying the last sheet S from the optional sheet supplying device 21), image formation is not started for the page following the last sheet S.

Accordingly, while the same control is carried out as with the first embodiment in the event of supplying sheets from the optional sheet supplying devices 21 and 22, the problem which is solved by the first embodiment does not occur in the event of supplying sheets S from the optional sheet supplying devices 23 and 24, so control different from that of the first embodiment is executed. That is to say, control is effected according to the position that each optional sheet supplying device is connected to the image formation apparatus 1.

Figure 6:
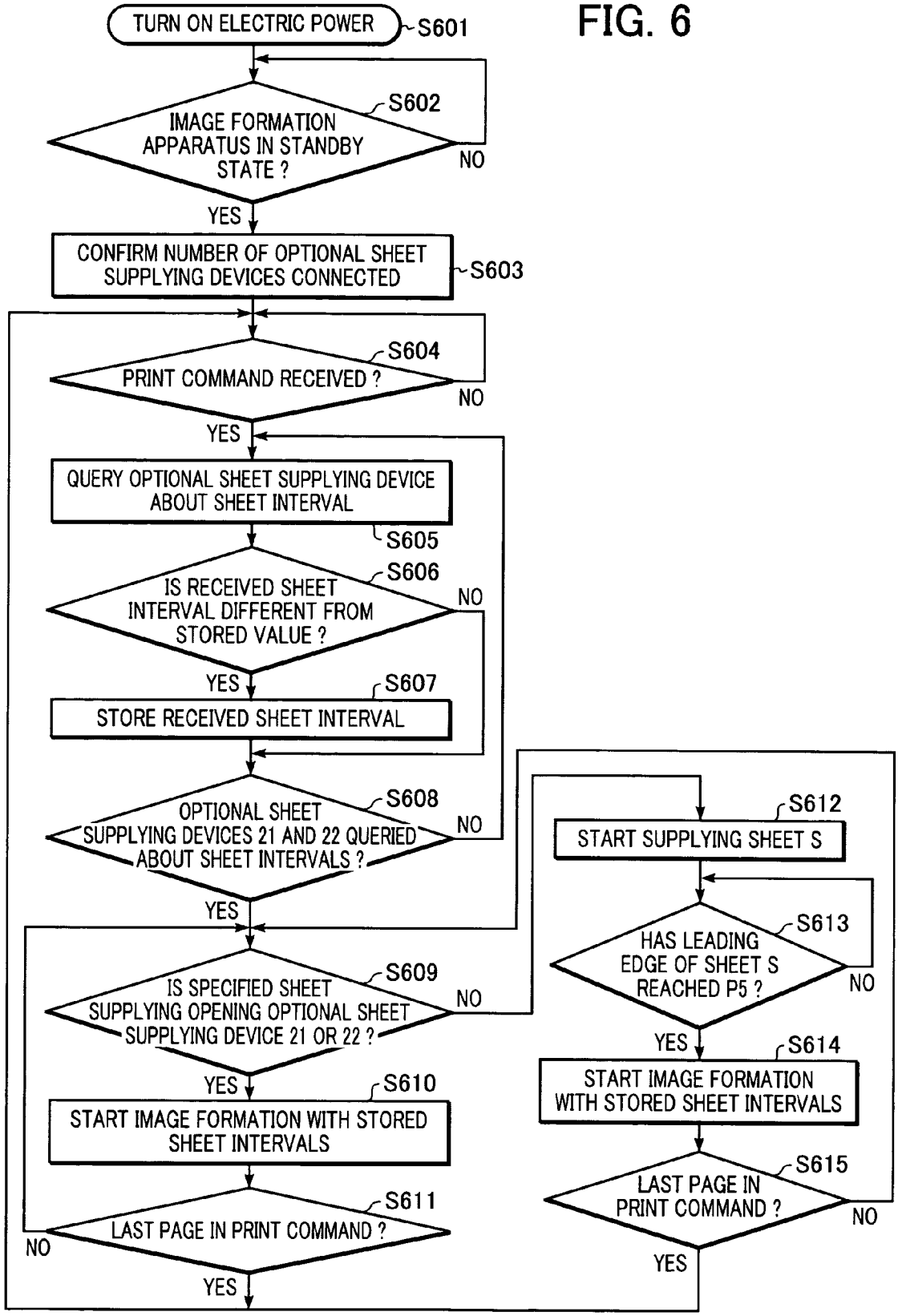
FIG. 6 is a flowchart illustrating the operations of the full-color image formation apparatus using intermediate transfer.

Next, the operations of the full-color image formation apparatus 1 and the optional sheet supplying devices 21 through 24 according to the second embodiment will be described with reference to the flowchart shown in FIG. 6.

In step S601, the operations of the image formation apparatus 1 are started by the electric power source being turned on. Specifically, as initialization actions of the image formation apparatus 1 for reaching a standby state wherein image formation can be made, the charging control unit 205 controls the charging voltages to be applied to the charging rollers 25, so as to charge the photosensitive drums 11 to a predetermined potential. Also, at the time of initialization, the photosensitive drums 11, intermediate transfer belt 3, secondary roller 4, and so forth, are rotationally driven by a driving motor (not shown) under control of the sheet transporting control unit 204.

In step S602, determination is made whether or not the image formation apparatus 1 has made transition to a standby state wherein image formation can be made, and in the event that this is determined to be so (YES in step S602), the flow proceeds to step S603.

In step S603, the image processing controller 201 confirms or determines the number of optional sheet supplying devices connected to the image formation apparatus 1 by communication via the interface 213.

In step S604, the image processing controller 201 determines whether or not a print command has been received from the host computer 200, and in the event that a print command has been received, proceeds to step S605. Note that a print command includes information such as the sheet supply portion for sheets S upon which the pages of the print command are to be printed (in FIG. 1, one of the sheet loading units 5*a*, 5*b*, and 5*c*), the number of pages to be printed with regard to the print command, and so forth.

In step S605, the image processing controller 201 transmits a command for notification of the sheet supplying interval via the interface 213 to an optional sheet supplying device detachable mounted to the image formation apparatus, to make a query regarding the sheet supplying interval. In the case of the configuration shown in FIG. 6, four, i.e., the optional sheet supplying devices 21, 22, 23, and 24, are connected to the image formation apparatus 1, but the query regarding the sheet supply interval is directed to the optional sheet supplying device 21 and optional sheet supplying device 22 directly connected to the image formation apparatus 1. On the other hand, the query regarding the sheet supply interval is not directed to the optional sheet supplying devices 23 and 24.

In the second embodiment, unlike the first embodiment, the two optional sheet supplying devices 23 and 24 are connected below the optional sheet supplying device 22. As described above, even in the event that the image formation interval for multiple pages are set at L1, image formation is not started at the intermediate transfer belt 3 for the following page at the point that detection is made that there are no more sheets S loaded on the sheet loading unit 5*d* or 5*e*. Also, the image processing controller 201 is capable of determining the connection position of the optional sheet supplying devices 23 and 24 by making communication with the optional sheet supplying devices 21 through 24 in step S604. Specifically, the image processing controller 201 is capable of determining that the optional sheet supplying device 23 is the third optional sheet supplying device from the top of the information processing apparatus 1, and that the optional sheet supplying device 24 is the fourth optional sheet supplying device from the top of the information processing apparatus 1.

Accordingly, the image processing controller determines that the optional sheet supplying devices 23 and 24 are optional sheet supplying devices connected to the image formation apparatus 1 as the third or subsequent optional sheet supplying devices whereby sufficient sheet transporting distance to the image formation apparatus 1 can be secured, and consequently does not transmit a command to the optional sheet supplying devices 23 and 24 to notify the sheet supply interval.

In step S606, the image processing controller 201 receives the information indicating the sheet supplying interval transmitted from the optional sheet supplying device control unit 211 in response to the query in step S605, and determines whether or not the received information indicating the sheet supplying interval differs from the information stored in a storage unit such as memory or the like (not shown) of the image formation controller 202 indicating the sheet supplying interval of the optional sheet supplying device 21. In the event that the stored information indicating the sheet supplying interval of the optional sheet supplying device 21 is different, the optional sheet supplying device 21 is determined to have switched the sheet supplying interval of the sheets S (YES in step S606), and the information indicating the new sheet supplying interval received from the optional sheet supplying device control unit 211 is stored in the memory of the image formation controller 202 (step S607). Note that the optional sheet supplying device 21 switches the sheet supplying interval of the sheets S in the event that the remaining number of the sheets S is small (e.g., 5% or less of the maximum load).

In step S606, in the event that the information regarding the sheet supplying interval received from the optional sheet supplying device control unit 211 is the same as the stored sheet supplying interval, the optional sheet supplying device 21 is determined not to have switched the sheet supplying interval of the sheets S (NO in step S606), and the flow proceeds to step S608.

In step S608, determination is made regarding where or not optional sheet supplying devices 21 and 22 detachably connected to the image formation apparatus 1 have been queried regarding the sheet supplying intervals. In the configuration shown in FIG. 5, following querying the optional sheet supplying device 21 regarding the sheet supplying interval, a judgment of NO is made and the flow proceeds to step S605 in order to query the optional sheet supplying device 22 in the same way. Following querying both optional sheet supplying devices 21 and 22, a judgment of YES is made and the flow proceeds to step S609.

In step S609, whether the sheet supplying portion specified in the printing command is the optional sheet supplying device 21 or 22, is determined. In the event that sheet supplying portion specified in the printing command is the optional sheet supplying device 21 or 22 (YES in step S609), the flow proceeds to step S610, and in the event that the sheet supplying portion specified in the printing command is the optional sheet supplying device 23 or 24, the flow proceeds to step S612.

In step S610, the image formation controller 202 starts image formation operations so as to transport the sheets S to the image formation block 2 at the sheet supplying intervals of each of the sheet supplying portions stored in the memory of the image formation controller 202. That is to say, in the event that the image formation controller 202 receives information indicating a new sheet supplying interval from the optional sheet supplying device 21 as a result of the query made to the optional sheet supplying device 21 by the image processing controller, determination is made that the information indicating the sheet supplying interval has been switched since the image formation operations relating to the previous printing command. The image formation controller 202 switches the sheet supplying interval from the sheet supplying interval (time interval) for transporting sheets S supplied from the optional sheet supplying device 21 for the previous printing command to a sheet supplying interval for the new printing command, and accordingly transports sheets S. The operations after image formation is started in step S610 is the same as the after image formation is started in step S609 in the first embodiment, so description thereof will be omitted.

In step S611, whether or not the image processing controller 201 has given an image formation command to the image formation controller 202 regarding the final page of the print command, and in the event that an image information command regarding the final page has not been made (NO in step S611), the flow returns to step S610 and an image formation command is given regarding the subsequent page. The image formation controller 202 which has received an image formation command from the image processing controller 201 transports a sheet S at the sheet supplying interval of the sheet supplying portion, specified in the printing command, stored in the memory of the image formation controller 202, and transport of the sheet S is started such that the sheet supplying interval is the same as with the previous page. In the event that an image formation command regarding the final page has been made (YES in step S611), the flow returns to step S604 and awaits reception of a new printing command from the host computer 200.

As described above, in the event that the sheet supplying interval of sheets S supplied from the optional sheet supplying device 21 or optional sheet supplying device 22 detachably connected to the image formation apparatus 1 is switched, the image formation apparatus 1 switches the sheet feeding interval of the sheets S being transported to the image formation block 2 as appropriate, so the image formation interval at the image formation block 2 can be expanded in the event that the number of sheets loaded in the optional sheet supplying device 21 or the optional sheet supplying device 22 is small (e.g., 5% or less of a full load). In the event that there are no more sheets in the optional sheet supplying device 21 or the optional sheet supplying device 22, image formation of the subsequent page is not started, so there is no formation of a toner image which cannot be transferred on the intermediate transfer belt 3.

In step S612, a sheet supply command to the effect that sheets S should be supplied is transmitted to the optional sheet supplying device 214 or 215, in order to start sheets supplying from the optional sheet supplying device 23 or 24 which is the sheet supplying portion specified in the printing command. Upon receiving the sheet supplying command, the optional sheet supplying device control unit starts supplying of the sheet S by driving the pick-up roller 7*d* or 7*e*. A sheet S supplied by the pick-up roller 7 is separated from the other sheets by a retarding roller 8 so as to prevent multiple sheets from being transported at once, and the sheet S is supplied to the image formation apparatus 1 by the transporting roller 9.

In step S613, whether or not the leading edge of the sheet S has reached P5 is determined. As described above, with the second embodiment, the distance from the first transfer nip portion N1 to the secondary transfer nip portion N2, and the distance from P5 in FIG. 5 to the secondary transfer nip portion N2, are equal, and accordingly there is no need to start image formation before starting supplying the sheet S, so the flow awaits the leading edge of the sheet S to reach P5.

Upon the leading edge of the sheet S reaching P5, image formation operations on the intermediate transfer belt 3 are started. The sheet S from the optional sheet supplying device 23 or 24 is transported by the transporting roller 9 and the resist roller pair 10 to the secondary transfer nip portion N2, where the color toner image is transferred from the intermediate transfer belt 3 to the sheet S at the secondary transfer nip portion N2. Subsequently, the image formation controller 202 causes the sheet S to pass through the fixing unit 14 whereby the color toner image thereupon is fixed, and the sheet S upon which the color toner image has been fixed is transported by a discharge roller 15 and is discharged to the discharge tray 16.

In step S615, whether or not the image processing controller 201 has given an image formation command to the image formation controller 202 regarding the final page of the print command, and in the event that an image information command regarding the final page has not been made (NO in step S614), the flow returns to step S609 and an image formation command is given regarding the subsequent page. The image formation controller 202 which has received an image formation command from the image processing controller 201 transports a sheet S at the sheet supplying interval stored in the memory of the image formation controller 202, and transport of the sheet S is started such that the sheet supplying interval is the same as with the previous page. In the event that an image formation command regarding the final page has been made (YES in step S615), the flow returns to step S604 and awaits reception of a new printing command from the host computer 200.

As described above, in the event that the sheet supplying interval of sheets S supplied from the optional sheet supplying device 21 or optional sheet supplying device 22 detachably connected to the image formation apparatus 1 is switched, the image formation apparatus 1 switches the sheet feeding interval of the sheets S being transported to the image formation block 2 as appropriate, so the image formation interval at the image formation block 2 can be expanded in the event that the number of sheets loaded in the optional sheet supplying device 21 or the optional sheet supplying device 22 is small (e.g., 5% or less of a full load). In the event that there are no more sheets in the optional sheet supplying device 21 or the optional sheet supplying device 22, image formation of the subsequent page is not started, so there is no formation of a toner image which cannot be transferred on the intermediate transfer belt 3. Also, the image formation apparatus 1 transmits a command to an optional sheet supplying device connected to the image formation apparatus 1 to notify the sheet supplying interval in the event that the connection position of the optional sheet supplying device is determined to be a predetermined position, so information indicating sheet supplying intervals is received from the desired optional sheet supplying device regarding which sheet supplying intervals need to be switched, and accordingly appropriate sheet transportation can be carried out.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus for forming images on sheets fed from two or more sheet supplying devices detachably mountable to the image forming apparatus, said image forming apparatus comprising:

a sheet transporting unit transporting said sheets fed from said sheet supplying devices;

an image formation unit forming an image on a transfer member;

a transfer unit transferring the image on the transfer member onto a sheet; and a control unit determining a connection position of each sheet supplying device and deciding whether to inquire of each sheet supplying device a sheet interval according to the connection position, wherein responsive to the control unit inquiring one of the sheet supplying devices, the one sheet supplying device transmits a sheet interval information according to an amount of sheets therein to the control unit, and wherein responsive to the one sheet supplying device transmitting the sheet interval information to the control unit, the control unit changes an image forming interval on the transfer member and a sheet feeding interval by the one sheet supplying device.

2. An image forming apparatus according to claim 1, wherein the sheet interval information includes a number of sheets in the one sheet supplying device.

3. An image forming apparatus according to claim 2, wherein in a case where the number of sheets in the one sheet supplying device is greater than a predetermined number of sheets, the control unit receives information relating to a first sheet feeding interval, and sets the image forming interval and the sheet feeding interval according to the information relating to said first sheet feeding interval; and wherein in a case where the number of sheets in said one sheet supplying device is less than or equal to said predetermined number of sheets, the control unit receives information relating to a second sheet feeding interval longer than said first sheet feeding interval, and sets the image forming interval and the sheet feeding interval according to the information relating to said second sheet feeding interval.

4. An image forming apparatus according to claim 3, wherein the image formation unit includes a plurality of image carrying members, each image carrying member carrying one color of a plurality of color toner images, wherein the transfer member includes an intermediate transfer member facilitating primary image transfer by contacting said plurality of image carrying members for transferring said plurality of color toner images onto said intermediate transfer member, and wherein th transfer unit facilitates secondary image transfer by transferring said plurality of color toner images from said intermediate transfer member onto a sheet.

5. An image forming apparatus according to claim 1, wherein in a case where the connection position is a position in which a sheet is fed from a sheet feeding device before the image is formed on the transfer member, the control unit does not inquire the sheet interval from the sheet supplying device feeding the sheet.

* * * * *